United States Patent [19]

Okada et al.

[11] 4,311,301

[45] Jan. 19, 1982

[54] GUIDE TROUGH FOR MOLTEN PRODUCTS

[75] Inventors: Tamio Okada, Warabi; Toshiaki Sano, Tokyo, both of Japan

[73] Assignee: Nippon Crucible Co., Ltd., Tokyo, Japan

[21] Appl. No.: 159,224

[22] PCT Filed: Jan. 25, 1979

[86] PCT No.: PCT/JP79/00016

§ 371 Date: Sep. 26, 1979

§ 102(e) Date: Sep. 26, 1979

[87] PCT Pub. No.: WO79/00550

PCT Pub. Date: Aug. 23, 1979

[51] Int. Cl.[3] ..... F27D 3/14

[52] U.S. Cl. ..... 266/196; 266/231

[58] Field of Search ..... 266/196, 231

[56] References Cited

U.S. PATENT DOCUMENTS 4,039,172 8/1977 Yoshida ..... 266/196

*Primary Examiner*—M. J. Andrews

*Attorney, Agent, or Firm*—Robert E. Burns; Emmanuel J. Lobato; Bruce L. Adams

[57] ABSTRACT

A guide trough for molten products comprising an elongated body made of monolithic refractory material. A runway for conducting molten products is formed in the top surface of the elongated body, and a pair of reinforcing beams are embedded within the elongated body extending longitudinally thereof on opposite sides of the runway and proximate the top surface in which the runway is formed. Cross-members are spaced apart longitudinally of the elongated body and extend across the bottom thereof for interconnecting the reinforcing beam. Recesses in the elongated body expose portions of the reinforcing beams to render accessible portions of the reinforcing beams to allow them to be engaged, in use, by hooks for lifting the guide trough.

5 Claims, 7 Drawing Figures

GUIDE TROUGH FOR MOLTEN PRODUCTS

FIELD OF THE INVENTION

This invention relates to improvements in guide troughs to be used for conducting molten products from a melting furnace, such as a blast furnace and an electric furnace, and more particularly to a large size guide trough constructed in one block with monolithic refractory material.

BACKGROUND OF THE INVENTION

In the recent tendency of the art, a long guide trough is constructed by stamping monolithic refractory material in one block instead of being constructed by brickworks, and transported and settled in the place where it is to be used. The method is also used for repairing the troughs, in which, when the inner surfaces of the troughs are worn by running molten products, whole of the trough is replaced with a new one instead of repairing by lining worn surfaces.

Such troughs are so heavy—some of them weigh about 1 ton or more—that the outside of the refractory body is reinforced by a supporting member, such as plates or frame works, which are usually provided with hook plates projecting upwards and having hook engaging holes for hanging the trough body.

As the hook plates are projecting upwards from the trough body, hook plates are exposed to the heat radiation and splashes of the hot running molten products while in use, and this may weaken the hook plates and cause damages. Further, piling up of the troughs in the storage is hindered by such projections.

SUMMARY OF THE INVENTION

The guide trough of the present invention includes a long trough body made of the monolithic refractory material and provided with a runway for conducting molten products in the top surface thereof; a supporting means for supporting said trough body having a couple of holding beams embedded longitudinally in the upper portions of said trough body one on each side thereof said holding beams being connected by longitudinally spaced apart supporting cross members extending across the bottom of the trough body; and hook engaging means provided on the holding beams, each of the hook engaging means having enough space formed around the holding beams so as to reveal a part thereof for engaging hook means. Thus a strong and rigid supporting and hook engaging means may be provided, as well as the hook engaging means does not project out from the trough body, so that it is not exposed to the heat radiation nor splashes of hot running molten products and the damages thereof can be prevented absolutely. Also, the troughs may be piled up easily in the storage.

The invention will be described in more detail with reference to the accompanying drawings.

DESCRIPTION OF THE PREFERRED EMBODIMENT

Figure 1:
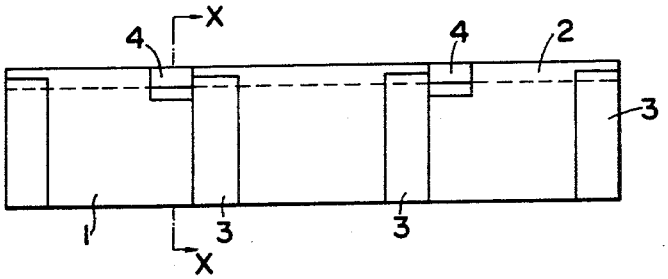
FIG. 1 is a side view of a trough according to the present invention.
Figure 2:
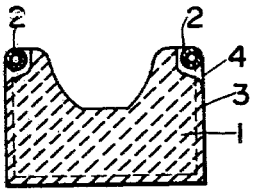
FIG. 2 is a cross-sectional view taken along line X—X of FIG. 1.
Figure 3:
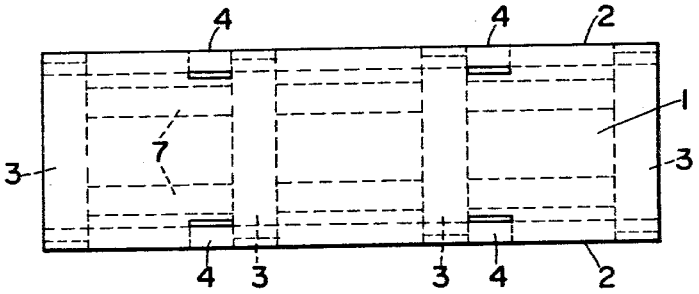
FIG. 3 is a top plan view of the trough in FIG. 1.

The trough shown in FIG. 1–FIG. 3 includes a long body 1 formed by stamping monolithic refractory material and provided with a runway for conducting molten products in the top surface.

Figure 6:
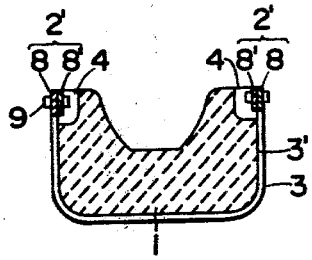
FIG. 6 is a cross-sectional view taken along line Y—Y of FIG. 5.

The body 1 is reinforced by a couple of holding beams 2 of cylindrical form embedded longitudinally in the upper portions of the trough body on each side thereof. The holding beams or reinforcing bars 2, shown with a hollow circular cross section in FIG. 2, may also have a solid non-circular cross section as shown in FIG. 6. The holding beams 2 are connected by longitudinally spaced apart U-shaped supporting cross-members 3 which extend across the bottom of the body 1.

Hook engaging means 4 are provided at suitable portions on the holding beams 2. Each of the hook engaging means 4 has a space formed around the holding beams 2 so that a part of them is exposed and accessible for being engaged by a hook. The hook engaging means 4 are defined by recesses that open at the upper surface of the body 1 for exposing and rendering accessible portions of the pair of holding beams or reinforcing rods 2 that are spaced along the length of the body 1, as shown in FIG. 3.

Figure 4:
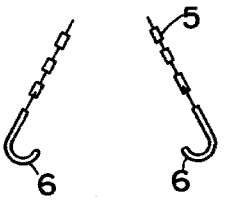
FIG. 4 is a partial front view showing one example of hook means.

The trough may be hung by engaging the hook 6 of the hanging members 5 such as shown in FIG. 4 with a portion of the holding beam 2 in the space of the hook engaging means 4, and thus the trough can be transported.

The hook engaging means 4 do not project or extent from the body 1 so that the troughs can be piled up easily in storage. Further, the hook engaging means 4 are not exposed to the heat radiation or splash of hot molten products running through the runway of body 1, so that the damage to the hook engaging means can be prevented.

Pipings, flat or angle bars may be used for the holding beams 2. Also connecting members 7 may be used for connecting and securing supporting cross members 3 at the bottom of the body 1 as shown in FIG. 3.

Figure 5:
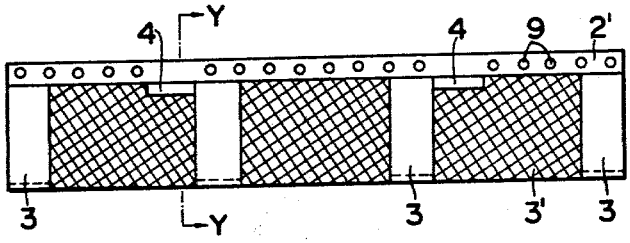
FIG. 5 is a side view of a trough of another embodiment of the present invention.
Figure 7:
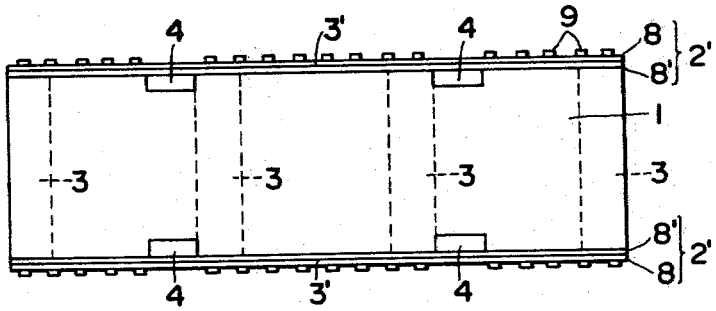
FIG. 7 is a top plan view of the trough in FIG. 5.

FIG. 5–FIG. 7 shows a trough of another embodiment of the present invention, in which two flat bars 8 and 8′ are used as a holding beam 2′.

Flat bars 8 and 8′ are piled up together with a reinforcing member such as wire nettings 3′ therebetween which is lined inside of the supporting cross members 3. Wire nettings 3′ are secured to the flat bars 8 and 8′ with bolts 9, and supporting cross members 3 are welded to the outside bar 8.

We claim:

1. A guide trough for molten products, comprising a long body made of monolithic refractory material and provided with a runway for conducting molten products in the top surface thereof; supporting means for supporting said body, said supporting means comprising a couple of holding beams embedded longitudinally in the upper portions of said trough body one on each side thereof, supporting cross-members, and said holding beams being connected by said supporting cross members longitudinally spaced apart and extending across the bottom of said trough body; and hook engaging means provided on said holding beams for engaging a hook, each of said hook engaging means having sufficient space formed around said holding beams so as to expose a part of said holding beams for engagement with a hook.

2. A trough for molten products, comprising: an elongate body comprised of monolithic refractory material and having an upper surface having a channel formed therein extending lengthwise of said elongate body, for conducting molten products in use; a pair of reinforcing bars embedded within said elongate body extending longitudinally thereof on opposite sides of the channel and proximate said upper surface in which the channel is formed; a plurality of support straps interconnecting said pair of reinforcing bars and extending under said elongate body and disposed at intervals along the length of said elongate body; and said elongate body having recesses opening at its upper surface for exposing and rendering accessible portions of said pair of reinforcing rods spaced along the length of said elongate body for permitting engagement of said reinforcing rods for lifting said elongate body.

3. A trough according to claim 2, wherein said plurality of support straps extend generally transversely of said elongate body, and said trough further comprising a second plurality of support straps extending between respective ones of the first-mentioned plurality of support straps under said elongate body longitudinally thereof.

4. A trough for molten products according to claim 2 or 3, wherein said pair of reinforcing bars are embedded substantially completely within said elongate body except said portions of said reinforcing bars exposed at the recesses in said elongate body.

5. A trough for molten products according to claim 2 or 3, wherein said elongate body has a pair of side surfaces on opposite sides of the channel formed in said upper surface of said elongate body and extending along the length of said elongate body, and said pair of reinforcing bars are each embedded in a respective side surface of said elongate body extending along the length of said elongate body and having an exposed side exposed along the respective side surface of said elongate body.

* * * * *